US005429919A

United States Patent [19]

Link et al.

[11] Patent Number: 5,429,919

[45] Date of Patent: Jul. 4, 1995

[54] SILVER HALIDE PHOTOGRAPHIC ELEMENTS WITH INCREASED CONTRAST

[75] Inventors: Steven G. Link; Kenneth J. Lushington; Roger Lok, all of Rochester, N.Y.

[73] Assignee: Eastman Kodak Company, Rochester, N.Y.

[21] Appl. No.: 130,031

[22] Filed: Sep. 30, 1993

[51] Int. Cl.[6] ..... G03C 1/005; G03C 1/06

[52] U.S. Cl. ..... 430/569; 430/567; 430/600; 430/611; 430/613; 430/614

[58] Field of Search ..... 430/569, 567, 611, 613, 430/614, 600

[56] References Cited

U.S. PATENT DOCUMENTS

| | | | |
|---|---|---|---|
| 2,278,947 | 4/1942 | Riester . | |
| 4,169,733 | 10/1979 | Iytaka et al. . | |
| 4,272,606 | 6/1981 | Mifune et al. | 430/600 |
| 4,808,516 | 2/1989 | Gingello et al. | 430/600 |
| 4,888,268 | 12/1989 | Itoh et al. | 430/218 |
| 4,906,558 | 3/1990 | Mucke et al. | 430/569 |
| 5,198,331 | 3/1993 | Takiguchi et al. | 430/569 |

FOREIGN PATENT DOCUMENTS

| | | |
|---|---|---|
| 0122125 | 10/1984 | European Pat. Off. . |
| 61/047942 | 3/1986 | Japan . |
| 62/299963 | 12/1987 | Japan . |
| 63/2043 | 1/1988 | Japan . |
| 63/46443 | 2/1988 | Japan . |
| 1155332 | 6/1989 | Japan . |

*Primary Examiner*—Charles L. Bowers, Jr.
*Assistant Examiner*—Mark F. Huff
*Attorney, Agent, or Firm*—Peter C. Cody

[57] ABSTRACT

A silver halide photographic element comprising a silver halide emulsion in reactive association with a compound of the formula wherein $R_1$, $R_2$ and $R_3$ are each independently an aryl, alkyl or arylalkyl group; and wherein Z represents the atoms necessary to form a 5 or 6 membered heterocyclic ring and contains at least one atom selected from N, O, S, and Se; and methods of making same.

7 Claims, 2 Drawing Sheets

SILVER HALIDE PHOTOGRAPHIC ELEMENTS WITH INCREASED CONTRAST

BACKGROUND OF THE INVENTION

This invention relates to a silver halide photographic element having increased contrast and a method of making same.

Conventional photographic elements contain emulsions of silver halide crystals which, upon exposure to light, form images. Silver halide in its unfinished or primitive state is only moderately sensitive to light in the blue region of the spectrum. Therefore, a silver halide emulsion is generally chemically modified to adjust its properties and optimize it for a particular photographic application. For example, chemical sensitizers may be added to increase the sensitivity (speed) of an emulsion; spectral sensitizing dyes may be added to extend the response of an emulsion to wavelengths where the silver halide does not normally respond; antifoggants may be added to reduce the developability of silver halide crystals in unexposed regions; and latent image keeping agents may be used to preserve the exposed image until it can be processed.

Even with all these chemical modifiers, often referred to as addenda, it is still sometimes impossible to build all of the desired characteristics into a silver halide emulsion for a particular application. This is because such chemical modifiers often interact with each other. For example, spectral sensitizing dyes may extend the intrinsic sensitivity of the emulsion to other wavelengths, but too much dye can cause dye desensitization and loss of speed. Antifoggants are effective at controlling unwanted development, but they may also cause loss of intrinsic speed. This problem is exacerbated in photographic elements having a high silver chloride content such as photosensitive paper used for color prints. Typically, silver chloride emulsions, which have a faster development rate, exhibit increased fogging characteristics and emulsion sensitivity changes owing to high temperatures and/or humidity conditions which may be incurred during storage.

One common problem in optimizing a silver halide emulsion is low contrast. Contrast as measured by gamma is the slope of the straight-line portion of the D-logE curve. Low contrast results in a poor discrimination between the highlights and the shadows of the developed image. Manipulation of chemical addenda may be effective at producing the desired fog level, photographic speed, granularity (a measure of signal-to-noise), and other properties such as pressure sensitivity, but the emulsion will be left with too low a contrast for the intended use. A position is often reached where further adjustment of addenda to increase contrast causes a deficiency in one or more other responses of the photographic element.

Antifoggants such as the tetraazaindenes may increase contrast, but the increase is accompanied by a loss in speed. Nucleating agents are incorporated into photographic vehicles or added to developers to increase contrast by boosting development in lithographic systems, but these agents cause large increases in contrast and degradation in grain and are not useful for optimizing the contrast of an emulsion for a non-lithographic application.

Japanese Kokai JP 62 80,647 describes 1,5,5-trialkylrhodanines as carriers for timed release of antifoggants. U.S. Pat. No. 4,808,516 describes the use of unsubstituted rhodanine in combination with a sensitizing dye to improve the contrast and speed of emulsions. U.S. Pat. No. 4,272,606 describes a method of forming high contrast images by developing a photographic element in the presence of a compound having a thioamido moiety in the molecular structure thereof; one such compound being a 5-substituted rhodanine. U.S. Pat. No. 4,906,558 describes ripening a silver chloride emulsion with a 5,5-disubstituted rhodanine gold compound. U.S. Pat. No. 2,278,947 describes sensitizing a silver halide emulsion with an N-substituted rhodanine compound. However, none of these rhodanine compounds provides the combination of speed and contrast desired for today's photographic elements.

The need exists for a chemical addenda for silver halide emulsions which increases the contrast of a developed image after exposure without affecting the other desirable properties of the emulsion. More specifically, the need exists for an addenda which can be added to an emulsion to increase the contrast of the developed image without causing a loss in photographic speed or an increase in fog level.

SUMMARY OF THE INVENTION

This invention provides a silver halide photographic element comprising a silver halide emulsion in reactive association with a compound of the formula

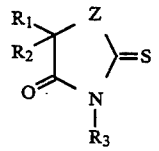

wherein $R_1$, $R_2$ and $R_3$ are each independently an aryl, alkyl or arylalkyl group, and wherein $R_1$ and $R_2$ may form a ring; and wherein Z represents the atoms necessary to form a 5 or 6 membered heterocyclic ring and contains at least one atom selected from N, O, S, and Se. It further provides a silver halide emulsion containing compounds of the above formula.

It also provides a method of making a silver halide emulsion comprising precipitating, spectrally sensitizing, and chemically sensitizing the emulsion and then adding to the emulsion a compound of the above formula. It further provides emulsions prepared by said method.

The photographic elements and emulsions of this invention have increased contrast upon exposure and development without speed loss or increased fog. Other rhodanine compounds which are not disubstituted in the 5-position and substituted in the N position do not show this effect. Further, the photographic elements of this invention exhibit very little variation in sensitivity upon storage under high temperature and humidity.

FIGURES

FIG. 1 and FIG. 2 are D-logE curves which depict the improvement in contrast and granularity which is obtained when 5,5-dimethyl-N-phenylrhodanine is added to a silver halide emulsion. FIG. 1 is the control. In each figure the dotted line depicts the $\gamma$-normalized granularity which is defined as the raw granularity divided by the y of the D-logE curve. The solid line depicts the raw granularity.

DETAILED DESCRIPTION OF THE INVENTION

Figure 1:
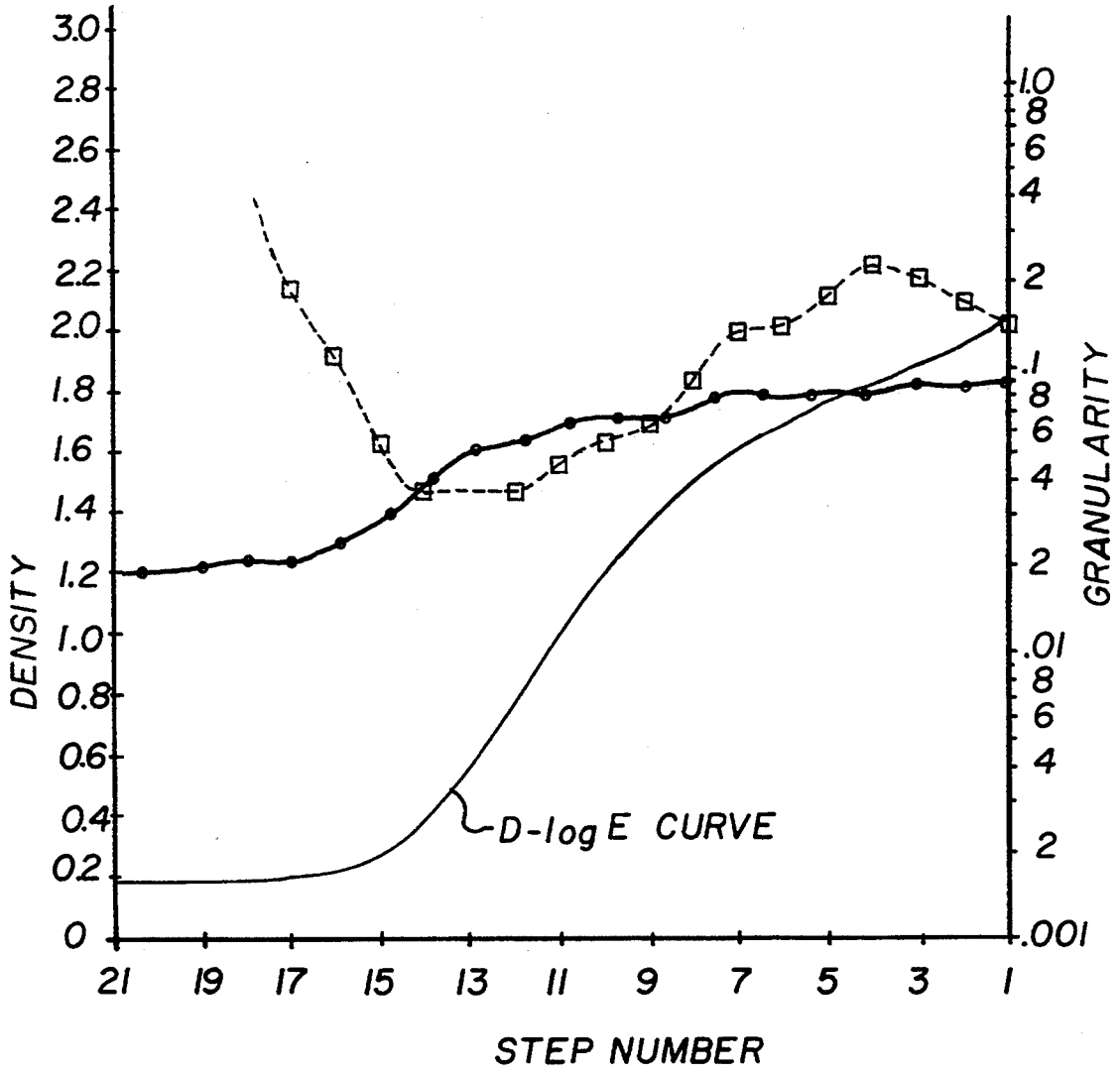
Figure 2:
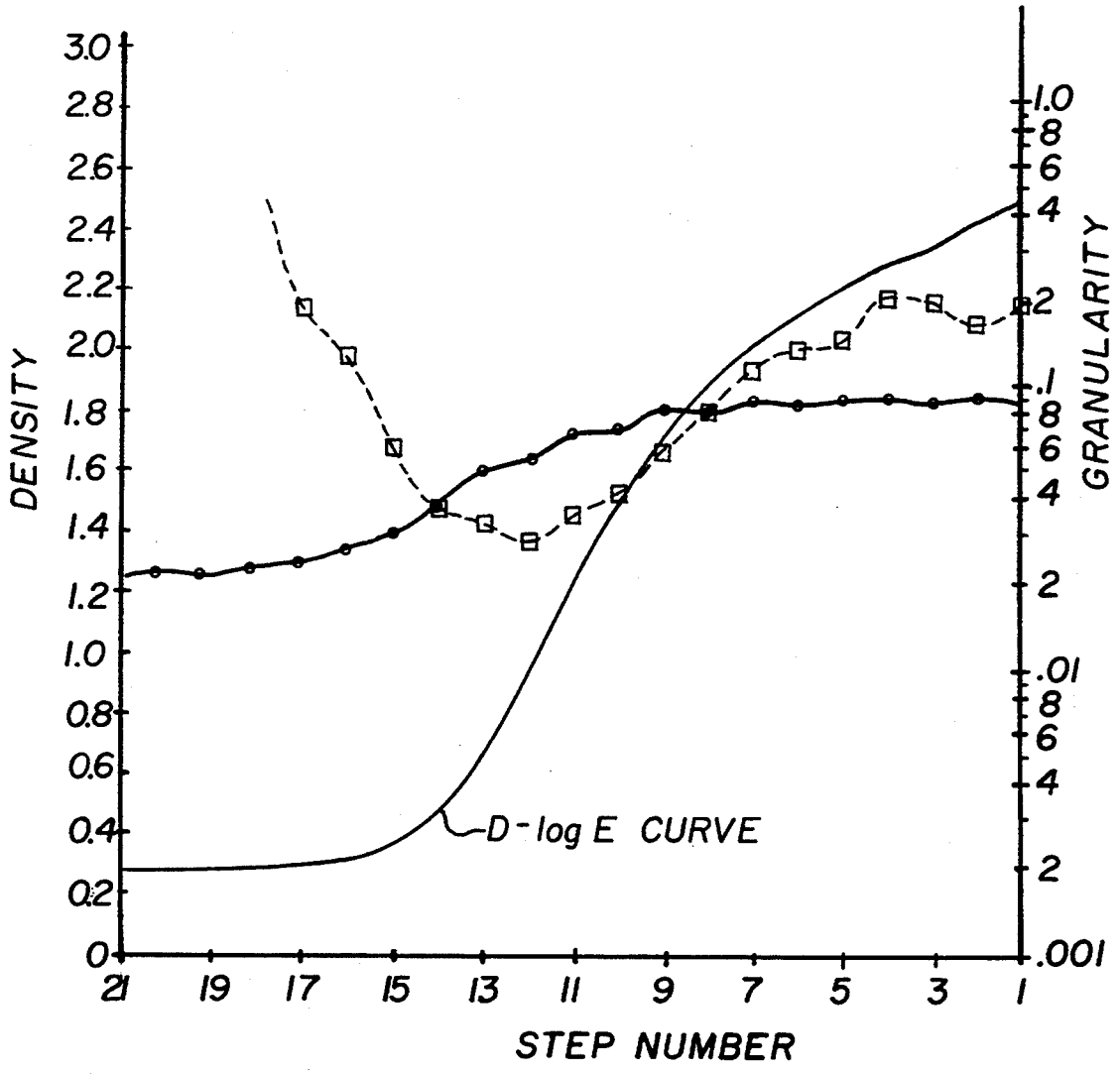

The compounds of this invention are represented by the following formula.

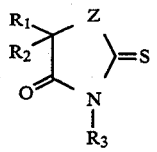

$R_1$, $R_2$ and $R_3$ each may be independently a substituted or unsubstituted aryl, alkyl, or arylalkyl group but not a H. $R_1$ and $R_2$ when taken together may form a ring. Suitable alkyl groups for $R_1$, $R_2$ and $R_3$may contain from 1 to 18 carbon atoms, with 1 to 8 being preferred, and 1 to 3 carbon atoms being most preferred. Suitable aryl groups for $R_1$, $R_2$ and $R_3$ may contain any number of fused aromatic or hetero aromatic rings, with preferred aryl groups containing 6 to 10 carbon atoms. Examples of preferred aryl groups are phenyl and naphthyl groups. Examples of preferred hetero aromatic groups include pyridyl, thienyl and furanyl. Suitable hetero atoms include O, S and N or their combinations.

Examples of suitable substituents for $R_1$, $R_2$and $R_3$ include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxyl groups, halogen atoms, aryloxy groups (for example, phenoxyl), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), acylamino groups, sulfonylamino groups, acyloxy groups (for example, acetoxy, benzoxyloxy), carboxyl groups, cyano groups, sulfo groups, and amino groups. Preferred are simple alkyl groups and acylamino groups.

Z represents the atoms necessary to form a 5 or 6 membered ring and contains at least one atom from the following group: N, O, S, Se. More preferably Z represents the atoms to form a 5 membered ring. Most preferably Z represents the atoms necessary to form a rhodanine ring.

Specific examples of the compounds of this invention are shown below.

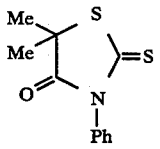

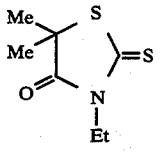

-continued

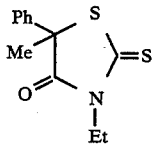

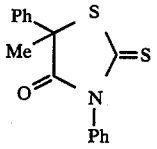

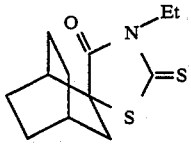

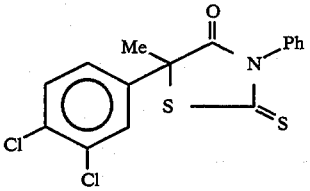

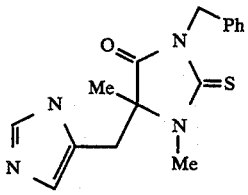

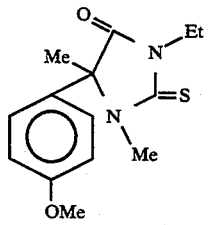

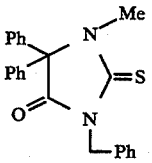

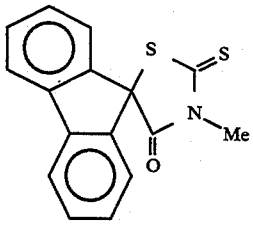

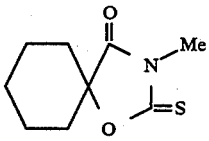

-continued

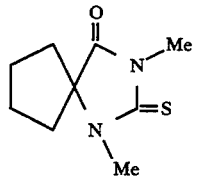

The compounds of this invention are easily prepared by one skilled in the art using readily available starting materials. One method of preparation of the rhodanines of this invention employs the reaction of a primary amine with carbon disulfide, followed by treatment with an α-halo, α-disubstituted carboxylic acid.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are chemically and spectrally sensitized, as known in the art. Chemical sensitization of the emulsion employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. A temperature rise is employed to complete chemical sensitization (heat treatment). Spectral sensitization is effected with agents such as sensitizing dyes. For color emulsions, dyes are added in the spectral sensitization step using any of a multitude of agents described in the art. It is known to add such dyes both before and after heat treatment.

After spectral sensitization, the emulsion is coated on a support. Various coating techniques include dip coating, air knife coating, curtain coating and extrusion coating.

The compounds of this invention may be added to the silver halide emulsion at any time during the preparation of the emulsion, i.e., during precipitation, during or before chemical sensitization or during final melting and co-mixing of the emulsion and additives for coating. It is preferred to add the compounds after spectral and chemical sensitization.

The compounds may be added to any layer where they are in reactive association with the silver halide. By "in reactive association with" it is meant that the compounds must be contained in the silver halide emulsion layer or in a layer whereby they can react or interreact with the silver halide emulsion. For example, they can also be added to overcoats or interlayers.

The compounds may be added as a solution using methanol or other organic solvents. For example, the compound can be added from a dimethylformamide solution. They may also be added as a dispersion of fine particles prepared by ball or media milling. The concentration of the inventive compounds which may be utilized is from about 0.01 to 5.0 mmole/mole Ag, with 0.01 to 1.0 being preferred and about 0.1 to 0.5 being most preferred.

Combinations of the compounds of this invention may be used. The compounds also may also be used in combination with other chemical addenda.

The compounds of this invention may be utilized with any type of silver halide emulsion, for example silver bromide, silver iodobromide, silver iodochlorobromide, silver chlorobromide, and silver chloride. In one embodiment of the invention it is preferred that the silver halide emulsion contain at least 50 mole % silver chloride, and more preferably 90 mole % silver chloride.

The photographic elements of this invention can be non-chromogenic silver image forming elements. They can be single color elements or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982. The element can contain additional layers such as filter layers, interlayers, overcoat layers, subbing layers and the like. This invention may be particularly useful with those photographic elements containing a magnetic backing such as described in No. 34390, *Research Disclosure*, November, 1992.

In the following discussion of suitable materials for use in the emulsions and elements of this invention, reference will be made to *Research Disclosure*, December 1989, Item 308119, published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure".

The silver halide emulsions employed in the elements of this invention can be either negative-working or positive-working. Examples of suitable emulsions and their preparation are described in Research Disclosure Sections I and II and the publications cited therein. Other suitable emulsions are (111) tabular silver chloride emulsions such as described in U.S. Pat. Nos. 5,176,991 (Jones et al); 5,176,992 (Maskasky et al); 5,178,997 (Maskasky); 5,178,998 (Maskasky et al); 5,183,732 (Maskasky); and 5,185,239 (Maskasky) and (100) tabular silver chloride emulsions such as described in EPO 534,395, published Mar. 31, 1993 (Brust et al). Some of the suitable vehicles for the emulsion layers and other layers of elements of this invention are described in Research Disclosure Section IX and the publications cited therein.

The silver halide emulsions can be chemically and spectrally sensitized in a variety of ways, examples of which are described in Sections III and IV of the Research Disclosure. The elements of this invention can include various dye-forming couplers including but not limited to those described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof can contain, among other things, brighteners (Examples in Research Disclosure Section V), antifoggants and stabilizers (Examples in Research Disclosure Section VI), antistain agents and image dye stabilizers (Examples in Research Disclosure Section VII, paragraphs I and J), light absorbing and scattering materials (Examples in Research Disclosure Section VIII), hardeners (Examples in Research Disclosure Section X), plasticizers and lubricants (Examples in Research Disclosure Section XII), antistatic agents (Examples in Research Disclosure Section XIII), matting agents (Examples in Research Disclosure Section XVI) and development modifiers (Examples in Research Disclosure Section XXI).

The photographic elements can be coated on a variety of supports including but not limited to those described in Research Disclosure Section XVII and the references described therein.

Photographic elements can be exposed to actinic radiation, typically in the visible region of the spectrum, to form a latent image as described in Research Disclosure Section XVIII and then processed to form a visible dye image examples of which are described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable, and then developed with a color developer. Additionally, the preceding process can be employed but before uniformly fogging the emulsion the remaining silver halide is dissolved and the developed silver is converted back to silver halide; the conventional E-6 process is then continued and results in a negative color image. Alternatively, a direct positive emulsion can be employed to obtain a positive image.

Development is followed by the conventional steps of bleaching, fixing, or bleach-fixing, to remove silver and silver halide, washing and drying.

The following examples are intended to illustrate, without limiting, this invention.

EXAMPLES

Example 1

Synthesis of the contrast-enhancing agent 5,5-Dimethyl-N-phenylrhodanine (DMPR).

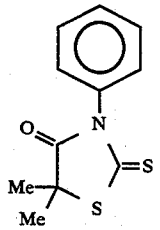

a) Aniline (220 mL, 2.40 moles) was added from a dropping funnel to a mixture of carbon disulfide (172 mL, 2.84 moles) and ammonium hydroxide (360 mL, 5.2 moles) cooled in an ice bath. The mixture was stirred for 30 minutes after addition was complete, then chilled for 2–3 hours. The product, ammonium phenyldithiocarbamate, precipitated. The solid was filtered, washed with 95% ethanol, then ether, and dried in air. The final weight was 325 g.

b) Ammonium phenyldithiocarbamate (93 g, 0.5 mole) and ethyl 2-bromoisobutyrate (98 g, 0.5 mole) were dissolved in ethanol (100 mL) and heated at reflux overnight. The ethanol was distilled off and the residue poured into ice water. The solid was filtered and recrystallized in 95% ethanol. The product had a final weight of 31.4 g and an M.P. of 107–108 degrees.

Example 2

A tabular silver iodobromide emulsion with an overall iodide content of 3% was precipitated by a standard double-jet method. The final emulsion was characterized and had a number weighted, average equivalent circular diameter of 3.2 μm and a thickness of 0.11 μm.

The emulsion was optimally sensitized using (per mole of silver) 4.1 μmoles of sodium aurous dithiosulfate dihydrate, 1.2 μmoles of potassium tetrachloroaurate, 1.0 mmole of sodium thiocyanate, and 54 μmoles of finish modifier A-1. These reagents were added at 40° C. to the melted emulsion 1 and the combined melt was heated at 1.66° C. $min^{-1}$ to 65 ° C., held there for 20 minutes and then chilled to 4° C. for storage.

A-1

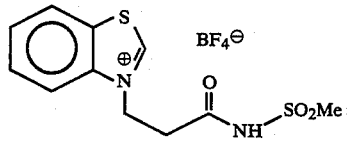

Just before coating, the above emulsion was remelted, divided, and several levels of DMPR and comparison rhodanine compounds I, II, and III were dissolved in dimethylformamide and were added to the different portions. The melts were coated on a 5 ml cellulose acetate base, with an incorporated gelatin pad (454 mg/$ft^2$), at a level of 75 mg Ag/$ft^2$ and 200 mg gelatin/$ft^2$. Yellow color coupler C-1 was incorporated in these coatings at a level of 100 mg/$ft^2$. An overcoat of 100 mg/$ft^2$ of gelatin was coated over the entire film structure. The coatings were hardened with bis(vinylsulfonyl)methane at a level of 1.5 wt % of the total gelatin content.

The dried coatings were photographically evaluated by exposing through a 0 to 4 density step tablet, using a 365 nm Hg line light source. The exposed samples were then processed for 3.25 min development in the KODAK C-41 process. Densities on the processed strips were read through a status M densitomenter.

The results for fog level, inertial speed and γ (point of maximum slope on the D-logE curve) are shown in Table 1. For purposes of comparison the speed of the coating with no added rhodanine compound has been defined to be 100 (in units of 100 logE).

TABLE I

| Coating | Compound | Level (mmol/mol Ag) | Speed | Fog | γ |
|---|---|---|---|---|---|
| 1 | None | — | 100 | 0.15 | 1.14 |
| 2 | (Invention) DMPR | 0.1 | 111 | 0.16 | 1.43 |
| 3 | (Invention) DMPR | 0.2 | 109 | 0.12 | 1.49 |
| 4 | (Invention) DMPR | 0.4 | 100 | 0.16 | 1.49 |

TABLE I-continued

| | | | | | |
|---|---|---|---|---|---|
| 5 | Comparison I | 0.2 | 103 | 0.11 | 1.19 |
| 6 | " | 0.8 | 100 | 0.10 | 1.01 |
| 7 | Comparison II | 0.2 | 109 | 0.11 | 1.16 |
| 8 | " | 0.4 | 110 | 0.09 | 1.22 |
| 9 | " | 0.8 | 108 | 0.13 | 1.18 |
| 10 | Comparison III | 0.4 | 85 | 0.08 | 1.29 |

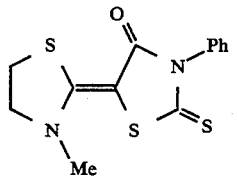

Comparison I

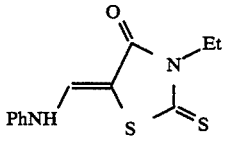

Comparison II

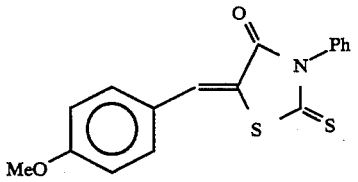

Comparison III

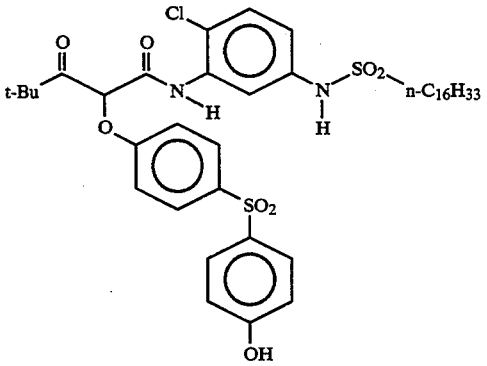

C-1

It can be seen form the data in Table 1 that the compound of the invention dramatically increases the contrast of the emulsion while having almost no detrimental effect on the speed or fog.

Example 3

This example was coated to assess the impact of the compounds of this invention on granularity. The coating format was the same as for Example 2 except that the level of C-1 was increased to 150 mg/ft$^2$. As in coating 2 of Example 2, 0.2 mmole/mole Ag of DMPR was added from a dimethylformamide solution. A control coating that omitted DMPR was also made.

The granularity of the coatings was determined by exposing the coatings through a 0–4 density diffuse 21 step tablet with a 3000K tungstem source with DLV and Wratten 2B filters. Each stepped exposure area was then scanned with a microdensitometer to determine the granularity. The results are shown in FIGS. 1 (control—no DMPR) and 2 (0.2 mmol DMPR/mole Ag).

From the figures it can be seen that the compound of the invention not only enhanced the contrast of the emulsion, but also caused a significant improvement in the $\gamma$-normalized granularity.

Example 4

Rhodanine compounds A through H were added at a concentration at 0.1 mmol/Ag mol to separate portions of a chemically and blue spectrally sensitized monodisperse silver chloride negative emulsion containing yellow dye-forming coupler $\alpha$-(4-(4-benzyloxy-phenyl-sulfonyl)phenoxy)-$\alpha$(pivalyl)-2-chloro-5-($\gamma$-(2,4-di-5-amylphenoxy)butyramido)acetanilide (1.08 g/m$^2$) in di-n-butylphthalate coupler solvent (0.27 g/m$^2$) and gelatin (1.51 g/m$^2$). 0.104 g of 1-(3-acetamidophenyl)-5-mercaptotetrazole and 1.033 g of potassium bromide per silver mole were also added. The emulsion (0.34 g Ag/m$^2$) was coated on a resin coated paper support and 1.076 g/m$^2$ of gel overcoat containing the hardener bis(vinylsulfonyl) methyl ether in an amount of 1.8% of the total gelatin weight was applied as a protective layer.

The coatings were given a 0.1 second exposure, using a 0–3 step tablet (0.15 increments) with a tungsten lamp designed to simulate a color negative print exposure source. This lamp had a color temperature of 3000° K., log lux 2.95, and the coatings were exposed through a combination of magenta and yellow filters, a 0.3 ND (Neutral Density), and a UV filter. The photographic samples were processed in a Colenta processor as follows: color development (45 sec, 35° C.), bleach-fix (45 sec, 35° C.), stabilization or water wash (90 sec, 35° C.) and drying (60 sec, 60° C.). The chemistry used in the Colenta processor consisted of the following solutions:

| | |
|---|---|
| Developer | |
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonyl aminoehtyl)-2-methyl-phenylenediaminesesquisulfate monohydrate | 5.0 g |
| Stilbene compound stain reducing agent | 2.3 g |
| Lithium sulfate | 2.7 g |
| Potassium chloride | 2.3 g |
| Potassium bromide | 0.025 g |
| Sequestering agent | 0.8 mL |
| Potassium carbonate | 25.0 g |
| Water to total 1 liter, pH adjusted to 10.12 | |
| Bleach-fix | |
| Ammonium sulfite | 58 g |
| Sodium thiosulfate | 8.7 g |
| Ethylenediaminetetracetic acid ferrica ammonium salt | 40 g |
| Acetic acid | 9.0 mL |
| Water to total 1 liter, pH adjusted to 6.2 | |
| Stabilizer | |
| Sodium citrate | 1 g |
| Water to total 1 liter, pH adjusted to 7.2 | |

The speed at 1.0 density point of the D-logE curve was taken as a measure of the sensitivity of the emulsion. Shoulder was taken at 0.3 log E units slower than the speed point along the D-logE curve. The results are shown in Table II.

A (DMPR)

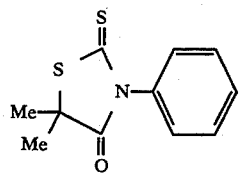

B

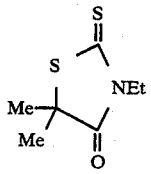

C

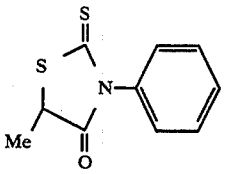

D

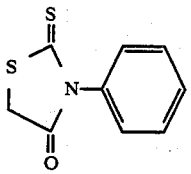

E

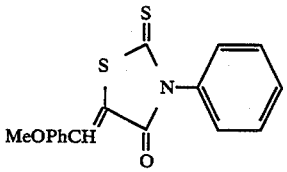

F

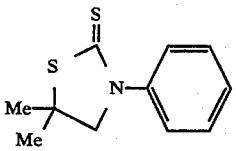

G

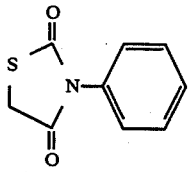

H

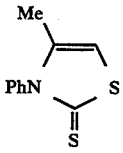

TABLE II

| Compound | Sample # | 1-week 0° F. Speed | D-min | Shoulder Contrast | 120 vs 0° F. ΔSpeed |
|---|---|---|---|---|---|
| Control | 1 | 162 | 0.06 | 1.96 | 21 |
| A | 2 | 171 | 0.07 | 2.01 | 6 |
| B | 3 | 173 | 0.07 | 2.00 | 2 |
| C | 4 | 126 | 0.35 | 1.90 | 22 |
| D | 5 | 73 | 0.06 | 1.81 | 64 |
| E | 6 | 150 | 0.07 | 1.98 | 29 |
| F | 7 | 161 | 0.07 | 2.01 | 29 |
| G | 8 | 162 | 0.07 | 1.97 | 20 |
| H | 9 | 157 | 0.07 | 2.00 | 28 |

As illustrated in Table II, the compounds of this invention, A and B, show a higher shoulder contrast with the additional advantage of a higher speed and little change in fog relative to the control. The comparison examples, C, D, E, F, G, and H either show no contrast benefit or the benefit with no speed enhancement. In addition, only the compounds of this invention show a much improved speed change due to storage under high temperature and humidity conditions. The specific pattern of substitution of the inventive compounds is what imparts the unusual and non-obvious beneficial photographic activity.

While the invention has been described in detail and with reference to specific embodiments thereof, it will be apparent to one skilled in the art that various changes and modifications can be made therein without departing from the spirit and scope thereof.

What is claimed is:

1. A method of making a silver halide emulsion comprising precipitating, spectrally sensitizing, and chemically sensitizing the emulsion and then adding to the emulsion a compound having the following formula

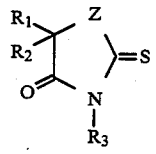

wherein $R_1$ and $R_2$ are each independently an aryl or alkyl group and $R_3$ is an aryl group having 6 to 10 carbon atoms or an alkyl group having 1 to 8 carbon atoms and $R_1$ and $R_2$ may form a ring; and wherein Z represents the atoms necessary to form a 5 or 6 membered heterocyclic ring and contains at least one atom selected from N, O, S, and Se.

2. The method of claim 1 wherein $R_1$ and $R_2$ are each independently an aryl group of 6 to 10 carbon atoms, or an alkyl group of 1 to 8 carbon atoms; and wherein Z represents the atoms necessary to form a rhodanine ring.

3. The method of claim 2 wherein $R_1$, $R_2$ and $R_3$ are each independently a phenyl group or an alkyl group of 1 to 3 carbon atoms.

4. The method of claim 1 wherein the silver halide emulsion is greater than 50 mol % silver chloride.

5. The method of claim 4 wherein the silver halide emulsion is greater than 90 mol % silver chloride.

6. A silver halide photographic element made by the method of claim 1.

7. A silver halide photographic element made by the method of claim 3.

* * * * *